US005465879A

United States Patent [19]

La et al.

[11] Patent Number: 5,465,879

[45] Date of Patent: Nov. 14, 1995

[54] DISPOSABLE NOZZLE ASSEMBLY FOR HIGH SPEED VISCOUS MATERIAL DROPLET DISPENSER

[75] Inventors: Duong La, San Diego; Carlos E. Bouras; Mark S. Meier, both of Encinitas; Thomas J. Roetker, San Diego, all of Calif.

[73] Assignee: Asymptotic Technologies, Inc., Carlsbad, Calif.

[21] Appl. No.: 187,644

[22] Filed: Jan. 27, 1994

[51] Int. Cl.[6] ..... B67D 5/58

[52] U.S. Cl. ..... 222/189.06; 222/321.6; 222/321.8; 222/340; 222/379; 222/409; 222/420; 222/493; 222/496; 222/514; 222/525; 277/152

[58] Field of Search ..... 222/189, 320, 222/321, 340, 378, 379, 409, 420, 422, 492, 493, 495, 496, 514, 523, 525, 568; 277/152, 212 C

[56] References Cited

U.S. PATENT DOCUMENTS

| | | | |
|---|---|---|---|
| 1,717,496 | 6/1929 | Coffin et al. | 222/378 X |
| 2,307,291 | 1/1943 | Packwood, Jr. | 222/518 X |
| 2,698,015 | 12/1954 | Brown | 222/409 X |
| 2,761,833 | 9/1956 | Ward | 222/189 X |
| 4,371,101 | 2/1983 | Cane et al. | 222/189 X |
| 4,830,227 | 5/1989 | Ball et al. | 222/386 X |
| 5,305,922 | 4/1994 | Varon | 222/379 X |

FOREIGN PATENT DOCUMENTS

| | | | |
|---|---|---|---|
| 747556 | 10/1944 | Germany | 277/212 C |
| 1809218 | 4/1993 | U.S.S.R. | 277/212 C |

*Primary Examiner*—Andres Kashnikow
*Assistant Examiner*—Joseph A. Kaufman
*Attorney, Agent, or Firm*—Baker, Maxham, Jester & Meador

[57] ABSTRACT

A disposable nozzle assembly for connection to the lower end of a syringe in a viscous material dispensing apparatus. The disposable nozzle assembly includes a nozzle portion having an internal cylindrical drop generation chamber and an exit orifice. A cylindrical feed tube having a central feed passage has a lower end that can slide up and down within the cylindrical drop generation chamber. A dynamic seal is provided on the lower end of the feed tube that prevents viscous material from escaping between the feed tube and the inner wall of the drop generation chamber. The disposable nozzle assembly is further provided with a modified luerlock fitting having an internal hollow stem that mates with the tapered nozzle of a standard adhesive syringe in a manner which prevents the entrapment of an air bubble in the fluid path when an empty syringe is replaced.

20 Claims, 2 Drawing Sheets

FIG. 1
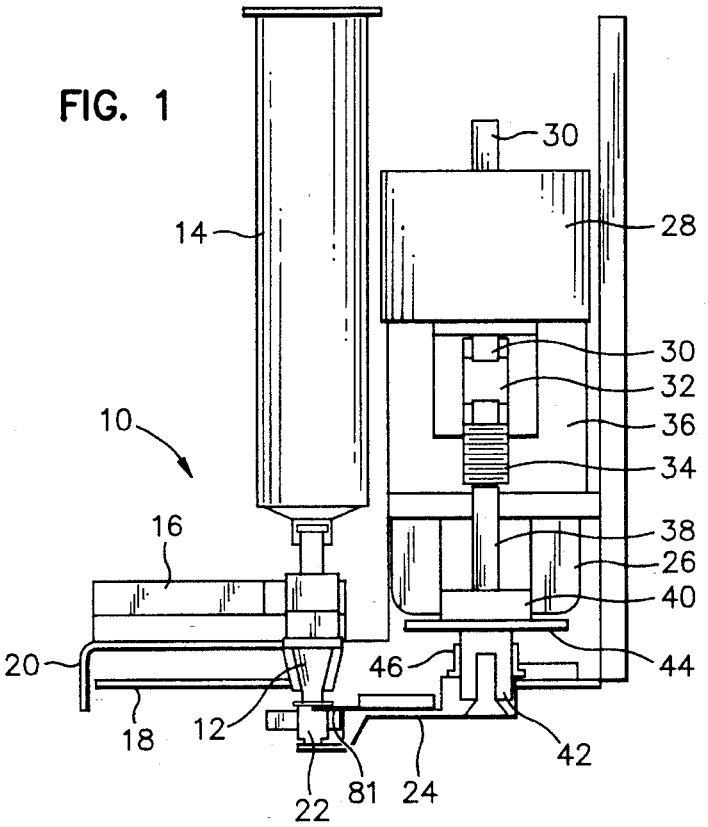
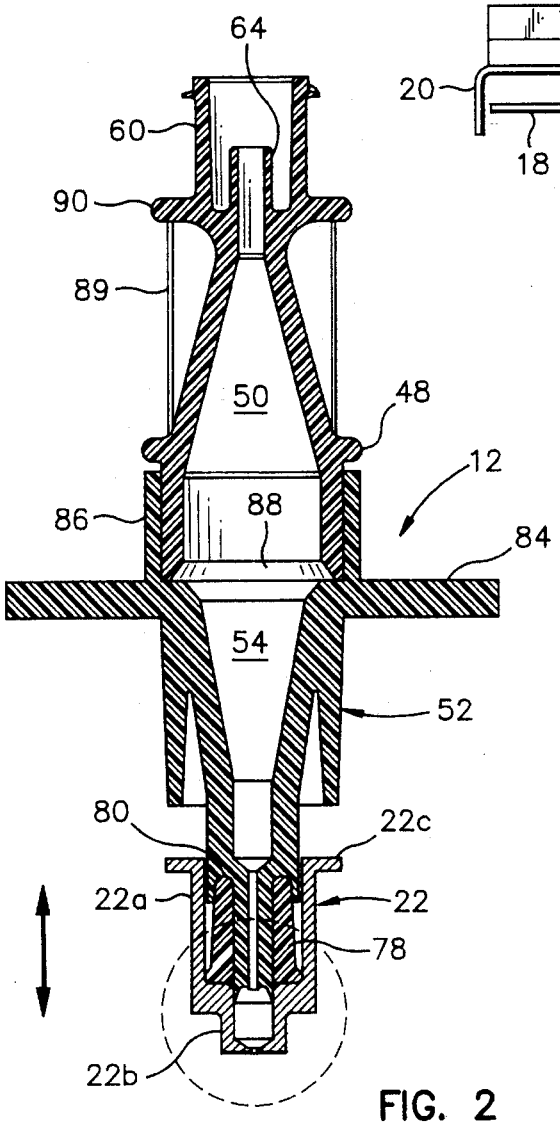
FIG. 2
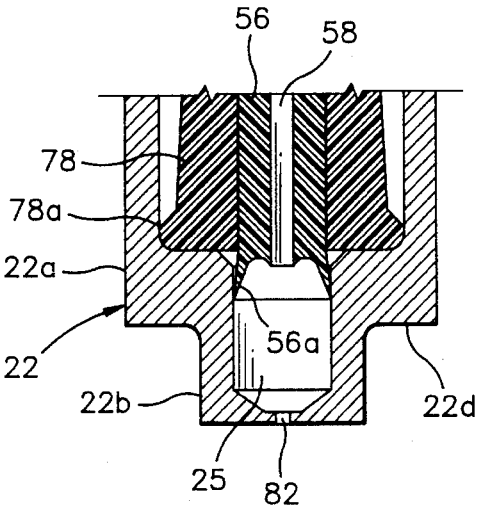
FIG. 3

DISPOSABLE NOZZLE ASSEMBLY FOR HIGH SPEED VISCOUS MATERIAL DROPLET DISPENSER

BACKGROUND OF THE INVENTION

The present invention relates to devices capable of dispensing minute droplets or dots of viscous material such as adhesives at very high rates, such as twenty dots per second. More particularly the present invention relates to a disposable nozzle assembly which is connected to a syringe filled with viscous material in such high speed dispensing devices.

The dispensing of adhesives quickly and reliably in the manufacture of circuit boards on which components are surface mounted is a difficult task. There are inherent speed limitations associated with rotary positive displacement valves, pneumatically actuated syringes and mechanically actuated pinch tubes used in conventional viscous material dispensers. Warped boards, air in the syringe, and stringing of the surface mount adhesive cause inconsistent dispensing and create the need for inspection and rework. As a result, the adhesive dispenser often becomes the bottleneck in the pick-and-place line.

Suppliers in the fluid dispensing industry have been able to make steady incremental improvements in dispensing speed over the past several years to achieve eights dots per second. However, inconsistencies and the need for inspection and rework were not adequately addressed until ASYMTEK of Carlsbad, Calif. developed the Dispense Jet (Trademark) apparatus disclosed in allowed U.S. patent application Ser. No. 07/978,783 filed Nov. 19, 1992, now U.S. Pat. No. 5,320,250, and entitled METHOD AND APPARATUS FOR RAPID DISPENSING OF MINUTE QUANTITIES OF VISCOUS MATERIALS. The Dispense Jet apparatus uses a nozzle and syringe in combination with a feed chamber. The nozzle is impacted by a solenoid actuated hammer to rapidly reduce the volume of the feed chamber. This causes a jet of viscous material to be ejected from the nozzle and to break away from the nozzle as a result of its own forward momentum. With this new system, it is possible to dispense 72,000 dots per hour from a single head "on the fly" as it passes laterally over a PC board. Adhesive stringing is eliminated with this approach because it does not require wetting of the workpiece surface as is the case with traditional syringe dispenser. The dots generated by the Dispense Jet apparatus have a consistent size regardless of height variations in the board due to warpage.

When traditional viscous material dispensers have been used to apply drops of adhesive and other viscous materials it has been necessary to periodically replace an empty syringe. Such syringes are standard in the industry and employ a luerlock type fitting. An air bubble frequently ends up being entrapped during syringe replacement. This causes problems for standard needle type dispensers that employ positive displacement valves and pinch tubes, and for the newer DispenseJet apparatus. These problems ultimately manifest themselves in the form of missing or variable size dots. The reason that such air bubbles form is that the sealing surfaces on the syringe and the fitting mate before the air trapped between them has a chance to be evacuated from the fluid path.

Standard viscous material dispensers have components, such as rotary positive displacement valves, that must be periodically cleaned. Such cleaning is not only required for regular maintenance, but is necessary when a switch is made in the type of viscous material being dispensed, e.g. from adhesive to potting compound. It is tedious to perform such cleaning, and the dispensing equipment experiences down time. New legislation banning the use of dangerous solvents and CFCs adds to the need to eliminate cleaning of dispenser components with solvents. The dispensing apparatus disclosed in the aforementioned patent application has a nozzle and feed chamber that need not be cleaned but has been designed to have all wetted parts be disposable.

SUMMARY OF THE INVENTION

Therefore, it is the primary object of the present invention to provide a disposable nozzle assembly for use in an apparatus capable of rapid dispensing of dots of viscous material without any need to wet the workpiece surface.

It is another object of the present invention to provide a nozzle assembly for a viscous material dispensing apparatus which prevents the entrapment of an air bubble in the fluid path when an empty syringe is replaced.

Our invention provides a disposable nozzle assembly for connection to the lower end of a syringe in a viscous material dispensing apparatus. Broadly, the disposable nozzle assembly includes a nozzle portion having an internal cylindrical drop generation chamber and an exit orifice. A cylindrical feed tube having a central feed passage has a lower end that can slide up and down within the cylindrical drop generation chamber. A dynamic seal is provided on the lower end of the feed tube that prevents viscous material from escaping between the feed tube and the inner wall of the drop generation chamber. The disposable nozzle assembly is further provided with a modified luerlock fitting having an internal hollow stem that mates with the tapered nozzle of a standard adhesive syringe in a manner which prevents the entrapment of an air bubble in the fluid path when an empty syringe is replaced.

BRIEF DESCRIPTION OF THE DRAWINGS

FIG. 1 is a side elevation view of an apparatus for rapidly dispensing minute droplets of viscous material which is equipped with a preferred embodiment of our disposable nozzle assembly.

FIG. 2 is an enlarged vertical sectional view of the preferred embodiment of our disposable nozzle.

FIG. 3 is a further enlarged view of the portion of FIG. 2 that is circled with a phantom line.

DETAILED DESCRIPTION OF THE PREFERRED EMBODIMENT

Figure 4:
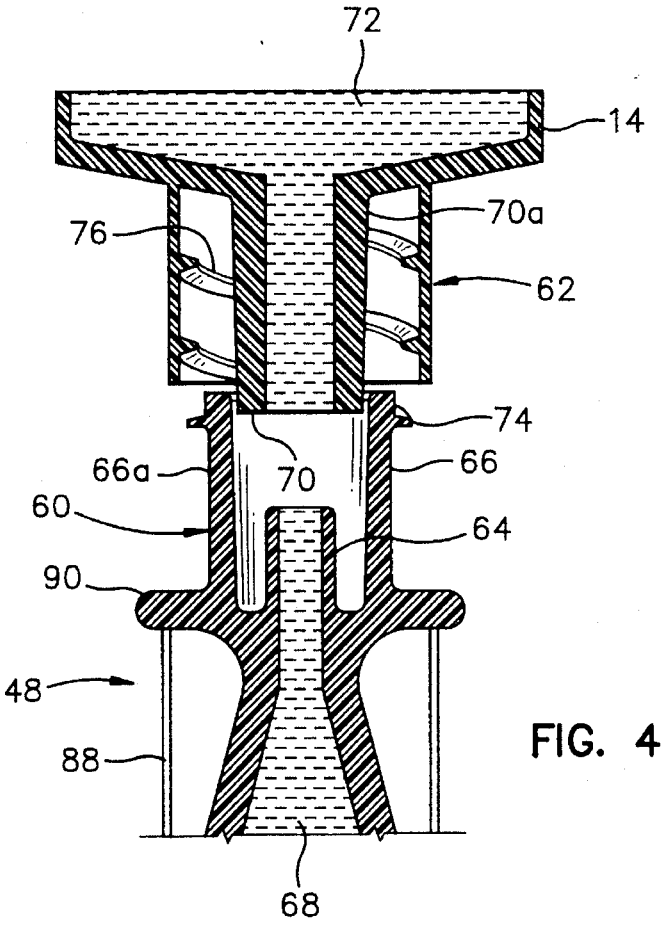
FIG. 4 is an enlarged fragmentary vertical sectional view of the upper end of the preferred embodiment of our disposable nozzle assembly showing its initial mating to the forward end of a standard syringe which is also shown in vertical section.
Figure 5:
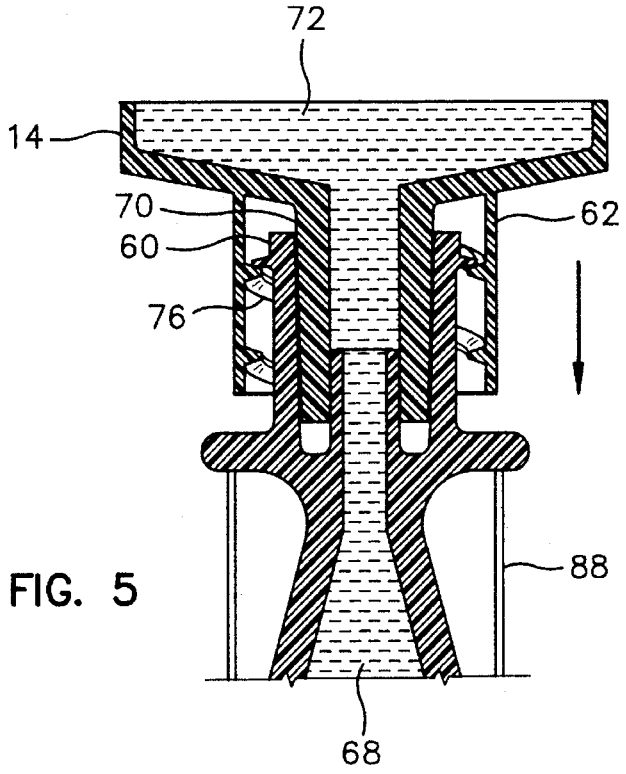
FIG. 5 is an enlarged fragmentary vertical sectional view of the upper end of the preferred embodiment of our disposable nozzle assembly showing its completed coupling to the forward end of a standard syringe which is also shown in vertical section.

Referring to FIG. 1, a high speed viscous material droplet dispensing apparatus 10 is illustrated which performs the method of the aforementioned patent application. It is equipped with a disposable nozzle assembly generally denoted 12 which is releasably coupled to the lower end of a conventional plastic syringe 14. A clamp 16 holds the connected syringe and nozzle 12 in position. A nut (not shown) applies pressure onto the clamp 16. A printed circuit board 18 carries electronic circuitry for heater elements, thermocouples and strain gauges associated with the nozzle. The circuit board 18 is enclosed in a protective cover 20.

The nozzle 12 assembly (FIG. 1) includes a lower portion 22 which is rapidly moved upwardly when the outer end of a metal hammer 24 strikes the same. This rapidly reduces the volume of an internal drop generation chamber 25 (FIG. 3) to cause the ejection of a jet of viscous material. The jet breaks away as a result of its own forward momentum to form a minute droplet that lands on the surface of the workpiece (not shown) to form a dot. The lower nozzle portion 22 is preferably made of a material which is chemically inert and has a high thermal conductivity, e.g. stainless steel, anodized aluminum, titanium alloy, or nickel plated brass.

The hammer 24 (FIG. 1 ) is rapidly pulled upwardly upon energization of a solenoid 26. A stepper motor 28 may be energized to vary the stroke of the hammer to thereby adjust the dot size. The lower end of the shaft 30 of the stepper motor 28 is connected through a coupling 32 to a threaded stop 34. The stop 34 screws up and down inside a threaded bore of a cylindrical support 36. The upper end of a rod 38 connected to the plunger 40 of the solenoid 26 strikes the lower end of the stop 34 to limit the upward stroke of the hammer 24. This in turn limits the amount of upward vertical motion of the metal nozzle portion 22 relative to the remainder of the nozzle 12. The inner end of the hammer 24 is connected to the plunger 40 of the solenoid 26 through a yoke assembly 42 including a plate 44. A bushing 46 surrounds a portion of the yoke assembly 42 and acts as a guide.

The major components of our disposable nozzle assembly 12 are best seen in FIG. 2. They all have a round cross-section over their entire lengths. The major components include an upper generally conical hollow body 48 defining an upper feed chamber 50, a lower generally conical hollow body 52 defining a lower feed chamber 54 and a cylindrical feed tube 56 (FIG. 3) with a cylindrical central feed passage 58. The upper body 48 includes a modified luerlock fitting 60 (FIG. 2) for connecting to the mating lower end 62 (FIG. 4) of the standard syringe 14.

The upper body 48 is formed with a concentric hollow stem 64 (FIG. 4) which extends longitudinally in a vertical direction about half the length of a surrounding cylindrical sleeve 66. The bore of the stem 64 communicates with the upper feed chamber 50. When the empty syringe 14 is removed, the viscous material 68 inside the stem 64 breaks at the upper end of the stem 64 leaving it full of viscous material. When a new full syringe 14 is mated to the modified leurlock fitting 60 the full stem 64 reaches up into the tapered syringe nozzle 70 of the lower end 62 of the syringe 14. Viscous material 72 within the syringe nozzle 70 contacts the viscous material 68 inside the stem 64. Threads 74 and 76 exist on the sleeve 66 and syringe end 62. At this time the conical sealing surfaces **66*a* and 70*a* of the sleeve 66 and syringe nozzle 70, respectively, have not yet fully mated. By the time these conical surfaces have fully mated, i.e. when the lower end 62 of the syringe 14 has been fully screwed onto the modified leurlock fitting 60 of the disposable nozzle 12, any air in the viscous material flow path has been displaced by the full stem 64**. There is no entrapped air remaining in the fluid path.

The lower metal nozzle portion 22 (FIG. 2) has a hollow upper larger diameter cylindrical portion **22*a* and a hollow lower smaller diameter portion 22*b*. The upper nozzle portion 22*a* encloses a cylindrical tubular elastomeric gasket 78 whose upper end seats in an annular recess 80 formed in the lower end of the lower nozzle body 52 and biases nozzle portion 22 to its outmost position. The lower metal nozzle portion 22 has a radial flange 22*c* that rests on a sensor 81 (FIG. 1** ) and is held in position by the sensor. The sensor is preferably a strain gauge.

The elastomeric gasket 78 (FIG. 3) has a central longitudinal bore through which the feed tube 56 extends. The upper end of the cylindrical feed tube 56 is integrally connected to the lower end of the lower nozzle body 52. The lower feed chamber 54 has three progressively inward tapering segments which communicate with the cylindrical feed passage 58 of the feed tube 56.

The lower end of the feed passage 58 (FIG. 3) opens into the drop generation chamber 25 inside the lower terminal smaller diameter portion **22*b* of the lower metal nozzle portion 22. The lower end of the feed tube 56 is formed with a bell shaped recess forming a peripheral beveled edge 56*a*. The beveled edge 56*a* of the feed tube slides up and down snugly against the inner wall of the drop generation chamber 25 to provide a dynamic seal. The feed tube 56 is preferably made of plastic. The beveled edge 56*a* is a thin section of plastic that is normally cylindrical on its outer side and has an inwardly tapered wall on its inside. It is sufficiently deformable under the pressures generated within the drop generation chamber 25** to provide the dynamic seal.

When the hammer 24 (FIG. 1) strikes the shoulder **22*d* (FIG. 3) of the lower metal nozzle portion 22, the metal nozzle portion 22 is moved rapidly upwardly. Prior to the hammer striking the metal nozzle portion 22 both the drop generation chamber 25 and the feed passage 58 are completely filled with viscous material. When the metal nozzle portion is struck, it moves violently upwardly relative to the feed tube 56, deforming the elastomeric gasket 78. The rapid increase in fluid pressure inside the drop generation chamber 25 pushes outwardly on the inside tapered wall of the beveled edge 56*a*. This flexes the thin section of plastic against the wall of the drop generation chamber 25** to provide a dynamic seal.

The sudden increase in fluid pressure inside the drop generation chamber 25 causes a jet of viscous material to be ejected from the partially tapered exit orifice 82 of the metal nozzle portion 22. There is substantial flow resistance in the feed passage 58 which results in viscous material ejection through the exist orifice 82. The rapid pressure increase inside the drop generation chamber 25 flexes the beveled edge **56*a* of the feed tube against the inner wall of the nozzle portion 22. The resulting dynamic seal prevents viscous material from escaping through any gap between the beveled edge 56*a* and the inner cylindrical wall of the nozzle portion 22 otherwise present due to manufacturing tolerances between the feed tube 56 and nozzle portion 22. The gasket 78 serves as a backup seal and return spring for the nozzle portion 22. The gasket 78 (FIG. 3) has an enlarged lower end portion 78*a* that contacts the inner wall of the upper larger diameter cylindrical portion 22*a* of the metal nozzle portion 22**.

The upper end of the lower body 52 (FIG. 2) of our disposable nozzle assembly 12 has a large radially extending flange 84 which assists in mounting to the dispensing apparatus. It also has a cylindrical coupling 86 which receives and is bonded to the lower cylindrical end of the upper body 48. Prior to the mating of the upper and lower bodies 48 and 52 a filter disk 88 is inserted which supports a diametrically extending circular section of stainless steel mesh, preferably of size 165×165 (lines per inch). Viscous material flowing from the upper feed chamber 50 to the lower feed chamber 54 must pass through this mesh filter. This prevents impurities from clogging the exit orifice 82. Vertically extending reinforcing ribs 89 connect the radial flange 90 of the leurlock fitting 60 to the conical portion of the upper body 48. The upper and lower bodies 48 and 52 are preferably made of injection molded plastic.

Our disposable nozzle assembly 12 is relatively small. By way of example, the outer diameter of the feed tube 56 is preferably between about 1.80 and 2.06 millimeters. The inside diameter of the drop generation chamber 25 is preferably between about 2.08 and 2.09 millimeters.

While we have described a preferred embodiment of our disposable nozzle assembly, it will be apparent to those skilled in the art that our invention can be modified in both arrangement and detail. Therefore, the protection afforded our invention should only be limited in accordance with the scope of the following claims.

We claim:

1. A nozzle assembly for connection to the lower end of a syringe in a viscous material dispensing apparatus, comprising:

a nozzle portion having an internal cylindrical pressurizing and drop generation chamber and an exit orifice;

a cylindrical feed tube having a central feed passage and a lower end that extends within and reciprocally mounts the cylindrical pressurizing and drop generation chamber;

means for providing a dynamic seal between the lower end of the feed tube and an inner wall of the cylindrical drop generation chamber.

2. A nozzle assembly according to claim 1 wherein the dynamic seal means comprises a beveled edge of predetermined size and thickness formed on the lower end of the feed tube.

3. A nozzle assembly according to claim 2 wherein the feed tube is made of a material such that the beveled edge will deform against the inner wall of the drop generation chamber under a predetermined fluid pressure within the drop generation chamber exerted against the lower end of the feed tube.

4. A nozzle assembly according to claim 1 wherein the nozzle portion further includes an enlarged diameter upper portion that surrounds the feed tube and defines a space therebetween.

5. A nozzle assembly according to claim 1 and further comprising;

an upper generally conical hollow body defining an upper feed chamber; and a lower generally conical hollow body defining a lower feed chamber, a lower end of the upper body being coupled to an upper end of the lower body, and a lower end of the lower body being connected to an upper end of the feed tube.

6. A nozzle assembly according to claim 5 and further comprising a filter separating the upper and lower feed chambers.

7. A nozzle assembly according to claim 5 and further comprising a cylindrical sleeve extending from an upper end of the upper body and having threads for mating with the lower end of a syringe having a tapered nozzle, and a stem extending upwardly within the sleeve and having a bore that communicates with the upper feed chamber, the stem being dimensioned to fit within the tapered nozzle of the syringe and extending upwardly a sufficient distance within the sleeve to ensure that air bubbles are eliminated when the nozzle and stem are both full of a viscous material and are mated.

8. A nozzle assembly according to claim 5 and further comprising a flange extending radially from the upper end of the lower body.

9. A nozzle assembly according to claim 5 and further comprising a cylindrical coupling formed on the upper end of the lower body for connecting to the lower end of the upper body.

10. A nozzle assembly according to claim 1 wherein the nozzle portion is made of a chemically inert material.

11. A nozzle assembly according to claim 1 wherein the nozzle portion is made of a material of high thermal conductivity.

12. A nozzle assembly according to claim 1 wherein the nozzle portion is reciprocable relative to the cylindrical feed tube.

13. A nozzle assembly for connection to the lower end of a syringe in a viscous material dispensing apparatus, comprising:

a nozzle portion having an internal cylindrical drop generation chamber and an exit orifice;

a cylindrical feed tube having a central feed passage and a lower end that can slide up and down within the cylindrical drop generation chamber, said nozzle portion further comprising an enlarged diameter upper portion that surrounds the feed tube and defines a space therebetween;

means for providing a dynamic seal between the lower end of the feed tube and an inner wall of the cylindrical drop generation chamber; and a gasket made of a resilient deformable material surrounding the feed tube and occupying the space between the feed tube and the upper enlarged diameter portion of the nozzle for being deformed when the nozzle portion is moved upwardly relative to the feed tube and for providing a spring force to return the nozzle portion downwardly.

14. A high speed droplet dispensing nozzle assembly for connection to the lower end of a syringe in a viscous material dispensing apparatus, comprising:

a tubular nozzle member having an internal cylindrical pressurizing and drop generation chamber and a fully open exit orifice communicating with said chamber;

an elongated cylindrical feed tube having a fully open central feed passage and a terminal end that extends into and reciprocally mounts said tubular nozzle member thereon; and means for providing a dynamic seal between said terminal end of the feed tube and an inner wall of the cylindrical drop generation chamber.

15. A nozzle assembly according to claim 14 wherein said dynamic seal comprises a bell shaped recess formed in said terminal end defining a beveled peripheral edge of predetermined size and thickness formed on said terminal end of said feed tube.

16. A nozzle assembly according to claim 15 wherein said feed tube is made of a material such that said beveled edge will deform against the inner wall of the drop generation chamber under a predetermined fluid pressure within said drop generation chamber exerted against said lower end of said feed tube.

17. A nozzle assembly according to claim 16 wherein said nozzle member further includes an enlarged diameter upper portion that surrounds said feed tube and defines a space therebetween, and an elastic tube mounted in said space and normally biasing said nozzle member to said outermost position.

18. A nozzle assembly according to claim 15 wherein said nozzle member is mounted on said cylindrical feed tube for movement between innermost and outermost positions; and means for normally biasing said nozzle member to said outermost position.

19. A nozzle assembly according to claim 18 wherein said dynamic seal comprises a bell shaped recess formed in said terminal end defining a deformable beveled peripheral edge of predetermined size and thickness formed on said terminal end of said feed tube.

20. A nozzle assembly according to claim 18 wherein said nozzle member further includes an enlarged diameter upper portion that surrounds said feed tube and defines a space therebetween, and said biasing means comprises an elastic tube mounted in said space and normally biasing said nozzle member to said outermost position.

* * * * *